United States Patent [19]

Mitsuo et al.

[11] 4,374,664

[45] Feb. 22, 1983

[54] PROCESS FOR DESULFURIZING MOLTEN PIG IRON

[75] Inventors: Toshiharu Mitsuo, Sakai; Takeshi Shoji, Takaishi; Shin-ichi Sanuki, Kishiwada, all of Japan

[73] Assignee: Nippon Steel Corporation, Japan

[21] Appl. No.: 122,077

[22] Filed: Feb. 15, 1980

[30] Foreign Application Priority Data

Feb. 16, 1979 [JP] Japan ..... 54-16067

[51] Int. Cl.[3] ..... C21C 7/02

[52] U.S. Cl. ..... 75/58; 75/53

[58] Field of Search ..... 75/53, 58

[56] References Cited

U.S. PATENT DOCUMENTS

| | | | |
|---|---|---|---|
| 3,929,464 | 12/1975 | Todd | 75/58 |
| 3,957,502 | 5/1976 | Cull | 75/58 |
| 3,998,625 | 12/1976 | Koros | 75/58 |
| 4,039,320 | 8/1977 | Uemura | 75/58 |
| 4,169,724 | 10/1979 | Freissmuth | 75/58 |

*Primary Examiner*—P. D. Rosenberg

*Attorney, Agent, or Firm*—Wenderoth, Lind & Ponack

[57] ABSTRACT

The present invention provides an improved process for desulfurization of molten pig iron by a first step of adding powdered aluminum to the molten pig iron and a second step of adding CaO to the molten pig iron, the improvement comprising adding the aluminum as a powdery mixture with CaO, alumina or both, whereby splashing associated with the addition of aluminum alone is reduced.

10 Claims, 5 Drawing Figures

PROCESS FOR DESULFURIZING MOLTEN PIG IRON

BACKGROUND OF THE INVENTION

1. Field of the Invention

The present invention relates to a process for desulfurizing molten pig iron, and more particularly to an improved process for desulfurizing molten pig iron.

2. The Prior Art

It is well known to use CaO as a desulfurizing agent in the desulfurization of molten pig iron, but CaO has been of limited use because of its poor desulfurization efficiency, as compared with other desulfurizing agents, such as $CaC_2$.

According to the studies made by the present inventors, the poor desulfurization efficiency of CaO seems to be due to the following fact. Silicon, inevitably present in molten pig iron, is oxidized on the surfaces of the injected particles of CaO desulfurizing agent, forming shells of calcium silicate ($2CaO.SiO_2$, $3CaO.SiO_2$) of high melting point on the surfaces of the particles and this interferes with the progress of the desulfurization reaction.

As a means of utilizing cheap CaO as a desulfurizing agent to reduce the desulfurization cost, the present inventors have found that injecting aluminum alone into the molten pig iron before injecting the CaO desulfurizing agent into the molten pig iron will improve the desulfurization efficiency of CaO. This concept is disclosed in Japanese patent application Ser. No. 102619/77. More specifically, Japanese patent application Ser. No. 102619/77 concerns a process for desulfurizing molten pig iron, characterized by first adding aluminum to molten pig iron, thereby adjusting an aluminum concentration to a specific one with respect to the silicon in the molten pig iron and to the sulfur to be removed. This addition of aluminum suppresses oxidation of silicon and supplements the aluminum which is consumed in the desulfurization reaction of the molten pig iron. Then, CaO having a given size below a specific size is added as a desulfurizing agent to the molten pig iron for desulfurization. The process of adding aluminum alone in advance of the CaO forms calcium aluminate which can prevent formation of the shells of calcium silicate, but it was found that such addition of aluminum alone to molten pig iron in advance of the CaO still had the following problems. Much splashing of molten pig iron takes place upon the addition of aluminum alone, although the reasons for this are not yet clear. Therefore, operational improvement is desired. Moreover, the injection of CaO after the completion of adding aluminum in advance prolongs the desulfurization time which is, for example, 20 to 35 minutes in a 250-ton mixer ladle car) by the time required for the addition of aluminum (for example, 3 to 5 minutes). Consequently, the temperature of molten iron is lowered, and supplementary energy is required in the subsequent process. The prolonged time promotes a damage to the refractory lining in the mixer ladle car.

Belgian Pat. No. 841,834 discloses a process for desulfurizing molten pig iron, wherein it is stated that it is advantageous to simultaneously conduct desulfurization and deoxidation with a strong deoxidizing agent such as aluminum to increase the efficiency of the desulfurizing agent. The desulfurization can also be improved by removal of oxygen via the reaction of aluminum therewith. However, the simultaneous injection of aluminum as the deoxidizing agent and a desulfurizing agent, until the desulfurization reaction is completed, consumes expensive aluminum very wastefully. On the other hand, a continuous injection of a lesser amount of aluminum to avoid such wasteful consumption considerably lowers the desulfurization efficiency.

Trentini et al., "Journal of the Iron and Steel Institute, France (Papers for Special Meeting)", June (1956), pages 124 to 133, in a paper entitled "Desulfurization of Liquid Pig Iron by Blowing with Lime Powder," discloses the simultaneous addition to aluminum and a desulfurizing agent to improve the desulfurization efficiency. Since this process is based on the simultaneous addition, it has the same problem as in said Belgian Pat. No. 831,834, and aluminum and magnesium of metallic elements are treated as equivalents in the art, and thus the art is basically different from the present invention in technical concept of desulfurization. That is, the art neither indicates nor suggests formation of calcium aluminate and the accompanying desulfurization reaction at all.

It has been found by the present inventors that the prior art technique of simultaneous addition of aluminum and CaO has a considerably lower desulfurization efficiency than the prior art technique of adding aluminum in advance of the CaO. That is, when aluminum is added continuously and simultaneously with CaO, i.e. throughout the CaO addition, the shells of calcium silicate are formed on the surface of CaO before the added aluminum reaches a desired concentration in the molten pig iron, and the formation of calcium aluminate cannot be promoted by the addition of the aluminum. Thus, it is necessary to add the entire amount of aluminum necessary for the desulfurization, that is, the amount necessary for establishing a desired aluminum concentration, at the initial stage of reaction. However, as stated above, this necessitates a means for preventing the splashing.

It is therefore, an object of the present invention to provide a process for desulfurizing molten pig iron characterized by:

(1) excellent desulfurization efficiency, as compared with the conventional process for desulfurizing molten pig iron only by CaO.

(2) excellent desulfurization efficiency, as compared with the conventional process of continuous and simultaneous addition of a mixture of CaO and aluminum, and (3) stable operation without any splashing of molten pig iron when aluminum is added, prolonged life of the refractory lining of a mixing vessel e.g. a mixer ladle car and shortened treating time, as compared with the conventional process of adding aluminum in advance of the CaO.

SUMMARY OF THE INVENTION

Said objects and effects of the present invention are attained according to the following process for desulfurizing molten pig iron.

The present process for desulfurizing molten pig iron comprises, in a first step, injecting a powdery mixture of one of aluminum and alumina, aluminum and CaO, or aluminum, alumina and CaO into molten pig iron and then, in a second step, injecting only CaO into the molten pig iron until the sulfur content of the molten pig iron reaches a desired level, the addition of said powdery mixture being performed until there is obtained a concentration of aluminum in the molten pig iron sufficient to increase the desulfurization efficiency of the CaO added in said second step.

DETAILED DESCRIPTION OF PREFERRED EMBODIMENTS

As a result of their study of the actual operation of desulfurization of molten pig iron, the present inventors have developed the present process, which will be described in detail below.

The addition of aluminum in advance of the CaO is very effective for the desulfurization, but this creates a problem in the splashing of molten pig iron when aluminum is added thereto, as already described above.

When the present inventors injected a powdery mixture of aluminum and alumina into molten pig iron, it was found that the splashing was much reduced, and also the treating time could be shortened. When a powdery mixture of aluminum and CaO or a powdery mixture of aluminum, CaO and alumina is similarly added to the molten pig iron, it was found that the splashing was eliminated, and safety could be much increased during the operation.

It is possible to replace CaO with quick lime or other material which contains CaO or is converted to CaO in the molten pig iron.

The reason for adding a powdery mixture of aluminum and alumina or CaO, or a powdery mixture of aluminum, alumina and CaO to the molten pig iron is the prevention of splashing as described above, although the reason for such preventive effect has not yet been clarified. As shown in the following Table 1, comparing extent of splashing under different conditions, the effect has been confirmed according to numerous tests.

Figure 1:
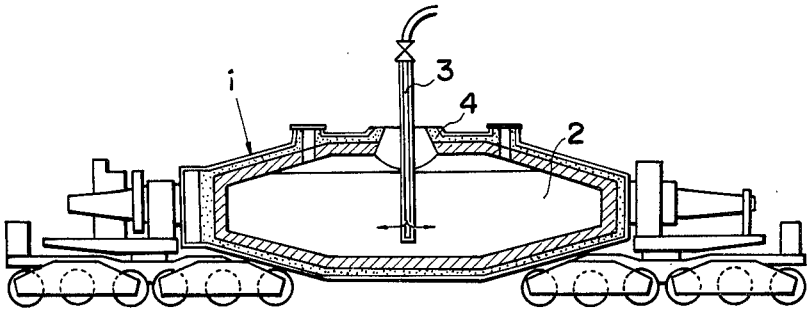
FIG. 1 is a schematic view of the desulfurization apparatus for performing the present invention.
Figure 3:
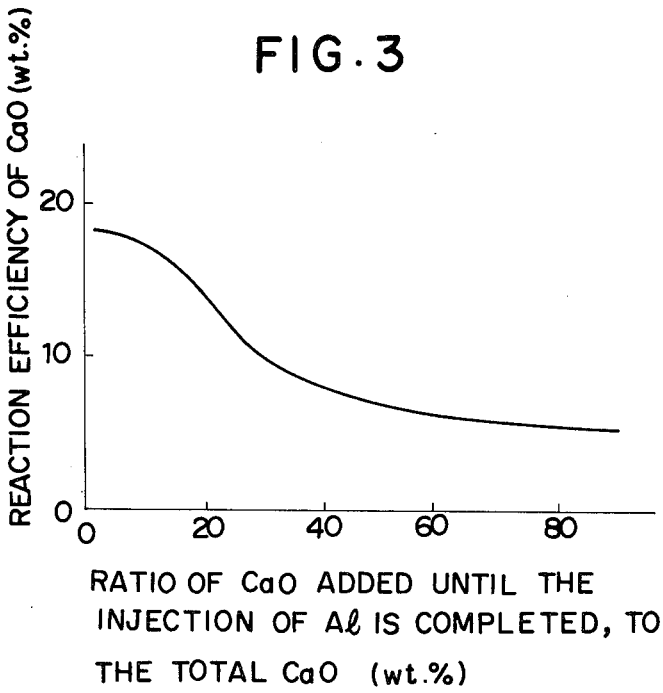
FIG. 3 is a graph of the relationship between reaction efficiency of CaO and ratio (wt.%) of (CaO added to the molten pig iron until the aluminum injection is completed) to (the total CaO added to the molten pig iron in the first step and the second step) in accordance with the present invention. The above-mentioned reaction efficiency of CaO means ratio (wt.%) of (CaO which was effective for desulfurizing the molten pig iron) to (the total CaO added to the molten pig iron in the first step and the second step).

Table 1 shows test results of various additions to a body of molten pig iron depicted in FIG. 1. In FIG. 1, 220 tons of molten pig iron 2 is in a 250-ton mixer ladle car 1. The additions are made through blow lance 3 and splashing occurs in the area of inlet 4. The splashing marks set forth in Table 1 represent an evaluation of the total amount of pig iron splashed and deposited around inlet 4. The larger the splashing mark, the more vigorous the splashing. The splashing marks range from 1 (least) to 5 (most).

Figure 2A:
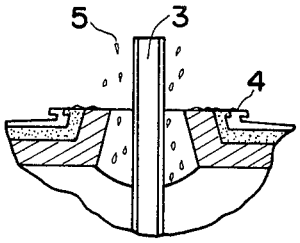
FIGS. 2(*a*) to (*c*) are enlarged schematical views of an inlet for molten pig iron in a mixer ladle car, showing splashing marks.
Figure 2B:
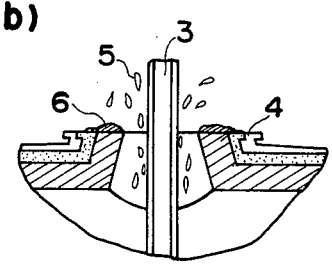
Figure 2C:
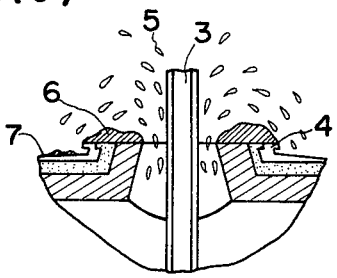

With reference to FIGS. 2(*a*), (*b*) and (*c*), splashing states 5 of molten pig iron and states 6 and 7 of solid pig iron deposited around the inlet 4 and outside iron drum shell of the mixer ladle car 1 by splashing, correspond to the splashing marks 1, 2 and 5, respectively.

In Table 1, the refractory life represents the life of a mixer ladle car (number of utilizable repetitions) in percentage, and the evaluation symbols have the following meanings: "X" poor, "Δ" somewhat poor, and "O" good.

The present invention will be described in further detail below.

A single addition of aluminum is effective for desulfurization, but splashing is vigorous, and the yield is lowered, for example, as shown in Run No. 5 of Table 1, and thus it is operationally disadvantageous. Furthermore, the time of addition is prolonged, and it is also disadvantageous as regards operating efficiency.

TABLE 1

| | | Amount added (Kg) | | | | | | | | | | | |
|---|---|---|---|---|---|---|---|---|---|---|---|---|---|
| | | Initial (the first step) | | | Final (the second step) | Total | Sulfur ($\times 10^{-3}$ wt. %) | | percent desulfurization | | | | |
| Run No. | Desulfurization procedure | Al (Kg) | $Al_2O_3$ (Kg) | CaO (Kg) | CaO (Kg) | CaO (Kg) | before | after | (wt. %) | Splashing mark | Treating time (min) | Refractory life | Evaluation |
| 1 | Only CaO added | — | — | | | 1250 | 40 | 22 | 45 | 1 | 29 | 100 | X |
| 2 | " | — | — | | | 1850 | 39 | 12 | 69 | 1 | 43 | 69 | |
| 3 | Simultaneous, | 50 | — | | | 1250 | 41 | 13 | 68 | 2 | 29 | 100 | Δ |
| 4 | continued addition of Al + CaO | 120 | — | | | 1250 | 40 | 8 | 80 | 2 | 29 | 95 | |
| 5 (comparative | Addition of Al in advance→CaO | 50 | — | | | 1250 | 41 | 5 | 87 | 5 | 34 | 85 | Δ |
| 6 (Example A) | Al + CaO→CaO | 50 | — | 100 | 1150 | 1250 | 40 | 6 | 85 | 2 | 29 | 95 | ○ |
| 7 (Example B) | Al + $Al_2O_3$→CaO | 50 | 50 | | 1250 | 1250 | 40 | 6 | 85 | 2 | 34 | 95 | ○ |
| 8 (Example C) | Al+$Al_2O_3$+CaO→CaO | 50 | 50 | 50 | 1200 | 1250 | 41 | 6 | 86 | 2 | 29 | 100 | ○ |

Thus, it is necessary to add a powdery mixture of aluminum and alumina, a powdery mixture of aluminum and CaO, or a powdery mixture of aluminum, alumina and CaO to pig iron, for example, as shown in Run Nos. 6 to 8 of Table 1. The preferred mixing ratio of the powdery mixtures is as follows:

Initially added amount of CaO/Al=0.5–2.0 (for example, Run No. 6).

$Al_2O_3/Al=0.5-2.0$ (for example, Run No. 7)

Initially added amount of $CaO=Al_2O_3/Al=1.0-2.0$ (for example, Run No. 8).

It is preferable from a practical standpoint that the initially added amount of CaO, $Al_2O_3$ or the initially added amount of $CaO+Al_2O_3$ in the powdery mixtures be almost equal to the amount of aluminum on a weight basis.

The lower the mixing ratio of $Al_2O_3$ and/or CaO to Al to be added in advance of the CaO, the smaller the effect of preventing the splashing. The higher the mixing ratio, the more the amount of the powdery mixture to be injected. The productivity is lowered and the temperature is considerably decreased thereby. According to the present inventors' experience, the effect of addition is low when the mixing ratio of alumina and/or CaO to aluminum to be added is less than 0.5, and a negative rather than a positive effect is significant when the mixing ratio is more than 2.0.

The amount of aluminum to be injected will be described below. According to a study made by the present inventors, it has been confirmed that a solubility of sulfur in CaO is less than 5 wt.% if calcium silicate is formed without the presence of aluminum in the molten pig iron, but reaches even 30 wt% if calcium aluminate is formed on the surface of the CaO in the presence of aluminum. The necessary amount of aluminum to be injected for enhancing the solubility of sulfur in the CaO through formation of calcium aluminate is determined in the following manner.

The concentration of aluminum which can suppress the oxidation of silicon naturally depends upon the concentration of silicon. As a result of tests, it has been found that the concentration of silicon normally in molten pig iron is 0.20 to 1.0 wt.%, whereas aluminum is effective in the weight amount of 0.01 to 0.1 times that of silicon. It seems that the range of effective amount of aluminum varies widely because the ratio of affinity of aluminum to silicon and to oxygen is not constant with their concentrations in the molten pig iron. In the case of a low concentration of silicon, said ratio of aluminum to silicon will be larger, whereas in the case of a high concentration of silicon, said ratio will be smaller. An effect can be obtained even if the ratio is more than 0.1, but the gradient of increase in the effect is reduced, and thus a ratio above 0.1 is not advantageous.

The aluminum present in the molten pig iron undergoes reactions shown by the following set of equations (1) during the desulfurization to form calcium aluminate, and is consumed. Thus, it is necessary to supplement the amount of aluminum consumed according, to the set of equations (1) even at the final stage of the desulfurization to suppress formation of calcium silicate by causing aluminum to suppress the oxidation of silicon.

$$CaO + \underline{S} \longrightarrow CaS + \underline{O} \quad (1)$$

$$3\underline{O} + 2Al \longrightarrow Al_2O_3$$

$$mCaO + nAl_2O_3 \longrightarrow mCaO.nAl_2O_3$$

The amount of aluminum required can be simply calculated by the following equation, that is, $$3CaO+3S+2Al \rightarrow 3CaS+Al_2O_3 \quad (2)$$

It is seen from the equation (2) that the amount of aluminum to be consumed is about $\frac{2}{3}$ of the weight amount of sulfur to be removed, and the amount of aluminum to be lost by the desulfurization is approximately $0.6\times\Delta S$ (wherein $\Delta S$ is the weight concentration of sulfur to be removed). In the test results, a fluctuation of $(0.2-1.0)\times\Delta S$ was however observed.

The concentration of aluminum to be so adjusted as to form calcium aluminate and enhance the solubility of sulfur in the CaO will be as follows:

Necessary weight concentration of aluminum=(0.01–0.1) ×(weight concentration of silicon in molten pig iron)+(0.2–1.0)×(weight concentration of sulfur to be removed)

Table 1 shows the time required for obtaining the desired amount of sulfur in samples of molten pig iron having almost identical compositions according to the present process and the comparative process, and it is obvious from Table 1 that in Run Nos. 6 and 8 the treatment time is shorter than in Run Nos. 2 and 5.

The present invention will be described in further detail with reference to the following specific Examples.

EXAMPLE A 150 kg of a powdery mixture of Al and CaO at a weight ratio of Al:CaO=1:2, was injected together with $N_2$ as a carrier gas into 220 tons of molten pig iron in a 250-ton mixer ladle car through an injection lance immersed in the molten pig iron over a period of 4.5 minutes, and then CaO was continuously injected therein for 29 minutes. The total amount of CaO injected was 1,250 kg, and the amount of sulfur in the molten pig iron was lowered from 0.040% by wt. before the treatment to 0.005% by wt. The splashing mark was 2. The results are as shown in Table 1, Run No. 6.

EXAMPLE B 100 kg of a powdery mixture of aluminum and alumina at a weight ratio of $Al:Al_2O_3=1:1$ was injected for 4.5 minutes together with $N_2$ as a carrier gas into 220 tons of molten pig iron in a 250-ton mixer ladle car through an injection lance immersed in the molten pig iron, and then 1,250 kg of CaO was continuously injected therein for 34 minutes, whereby the amount of sulfur in the molten pig iron was lowered from 0.040% to 0.006% by wt. The splashing mark was 2. The results are as shown in Table 1 Run No. 7.

EXAMPLE C 150 kg of a powdery mixture of aluminum, alumina and quick lime at a weight ratio of $Al:Al_2O_3=1:1:1$ was injected for 4.5 minutes together with $N_2$ as a carrier gas into 220 tons of molten pig iron in a 250-ton mixer ladle car through an injection lance immersed in the molten pig iron, and then CaO was continuously injected therein for 29 minutes. Total amount of CaO injected was 1,250 kg, whereby the amount of sulfur in the molten pig iron was reduced from 0.041% to 0.006% by wt. The splashing mark was 2. The results are as shown in Table 1 Run No. 6.

COMPARATIVE EXAMPLE 50 kg of aluminum powder was first injected for 4.5 minutes together with $N_2$ as a carrier gas into 220 tons of molten pig iron in a 250-ton mixer ladle car through an injection lance immersed in the molten pig iron, and then 1,250 kg of CaO was continuously injected therein for 29 minutes, whereby the amount of sulfur in the molten pig iron was reduced from 0.041% to 0.005% by wt. The immersed lance was vigorously vibrated during the injection of aluminum, and the molten pig iron was splashed through the inlet for molten pig iron, and also accumulated around the inlet at the same time. The splashing mark was 5.

The amount of CaO to be injected is determined in the following manner. That is, the amount of CaO to be injected is determined according to the unit consumption standard of the CaO as prepared from data for previous desulfurization runs using the sulfur analysis of a molten pig iron to be desulfurized and the desired sulfur content of desulfurized molten pig iron as parameters. One example of the unit consumption of quick lime is shown in Table 2, where the amount of CaO to be injected is obtained by multiplying the unit consumption of the CaO by the amount of molten pig iron to be desulfurized.

TABLE 2

| Sulfur content of molten pig iron to be desulfurized (wt. %) | Desired sulfur content (wt. %) Quick lime unit consumption (kg/ton of molten pig iron) | | |
|---|---|---|---|
| | 0.005 | 0.010 | 0.015 |
| 0.020 | 3.1 | 2.4 | 1.2 |
| 0.030 | 4.4 | 3.2 | 2.0 |
| 0.040 | 5.7 | 3.9 | 2.5 |

In the present invention, a good result can be obtained by injecting the necessary amount of aluminum into the molten pig iron before 15 wt.% of the amount of CaO to be injected is completed, in view of the desulfurization efficiency. When the remainder of the aluminum is added after 15 wt.% of the amount of CaO has been injected therein, shells of calcium silicate ($2CaO.SiO_2$. or $3CaO.SiO_2$) are formed on the surface of CaO, as described before. In consequence, the desulfurization efficiency of CaO is lowered, and an excessive amount of CaO is required. This gives a cost disadvantage, and also lowers the temperature of molten pig iron, making the overall process disadvantageous.

The relationship between the CaO reaction efficiency and percentage of CaO added until the aluminum injection is completed when aluminum and CaO are injected into the molten pig iron at the same time, for example, as shown in Table 1, Run No. 6. The sulfur concentration of the molten pig iron before the desulfurization is about 0.040 wt.%, and the amount of aluminum added is 0.02 wt.%. When the percentage of CaO added before the addition of aluminum is completed exceeds 15 wt.%, the reaction efficiency of CaO will be considerably lowered. Thus, it is preferable to inject a powdery mixture of aluminum and alumina, a powdery mixture of aluminum and quick lime, or a powdery mixture of aluminum, alumina and quick lime, for example, as shown in Table 1 as Run Nos. 6 and 8, into the molten pig iron before 15 weight % of the amount of CaO to be added is injected.

When the powdery mixture of aluminum and alumina is injected to the molten pig iron in the first step in such quantity that an aluminum concentration of the molten pig iron reaches a concentration sufficient to form calcium aluminate and sufficient to enhance a solubility of sulfur in CaO, and then CaO is added to the molten pig iron in the second step, the amount of aluminum to be injected in the first step can be the same as in the case of the powdery mixture of aluminum and quick lime and can satisfactorily reduce the splashing as well as can excellently heighten the desulfurization efficiency, as shown in Run No. 7 of Table 1. However, in this case, there is such a disadvantage that the time of addition is prolonged as also shown in Run No. 7 of Table 1 because CaO is not contained in the powdery mixture of aluminum and alumina to be injected in the first step at all.

In the case of injecting a powdery mixture of aluminum, alumina and quick lime, a good result can be also obtained with the same amount of aluminum as shown in Run No. 8 of Table 1.

As described above, the present invention provides a useful process for desulfurizing molten pig iron with CaO, assuring high efficiency, low cost and safe operation, without any substantial splashing of molten pig iron.

What is claimed is:

1. In a method for the desulfurization of molten pig iron by adding powdered aluminum and CaO to the molten pig iron, the improvement which comprises adding aluminum as a powder with CaO, alumina or both, whereby splashing associated with the addition of aluminum alone is reduced and wherein the aluminum is added in a quantity sufficient to have an aluminum concentration in the molten pig iron by weight % of (0.01–0.1)×(the concentration of silicon in the molten pig iron by weight %)+(0.2–1.0)× (concentration of sulfur by weight % to be removed from the molten pig iron).

2. The method according to claim 1 wherein the addition of the powdery mixture of aluminum and CaO, or the powdery mixture of aluminum and alumina, or the powdery mixture of aluminum, alumina and CaO is completed before 15% by weight of the total CaO to be added is added.

3. The method according to claim 1 wherein the weight ratio of aluminum to one or both of alumina and CaO is 0.50–2.0.

4. The method according to claim 1 wherein CaO is employed in the form of quick lime.

5. The method according to claim 1 wherein the additions in said first and second steps are made by introducing the materials to be added beneath the surface of the molten pig iron.

6. The method according to claim 1 wherein the additions are made in combination with a carrier gas.

7. The method according to claim 1, wherein the carrier gas is inert.

8. The method according to claim 1 wherein said powdery mixture comprises aluminum and CaO.

9. The method according to claim 1 wherein said powdery mixture comprises aluminum and alumina.

10. The method according to claim 9 wherein said powdery mixture comprises aluminum, alumina and CaO.

* * * * *